US011866811B2

(12) United States Patent
Jung et al.

(10) Patent No.: US 11,866,811 B2
(45) **Date of Patent: *Jan. 9, 2024**

(54) FE-BASED ALLOY

(71) Applicant: KOREA INSTITUTE OF INDUSTRIAL TECHNOLOGY, Cheonan (KR)

(72) Inventors: Hyo Yun Jung, Ulsan (KR); Kwang Su Choi, Daegu (KR); Ji Yong Hwang, Daegu (KR)

(73) Assignee: KOREA INSTITUTE OF INDUSTRIAL TECHNOLOGY, Cheonan (KR)

( * ) Notice: Subject to any disclaimer, the term of this patent is extended or adjusted under 35 U.S.C. 154(b) by 22 days.

This patent is subject to a terminal disclaimer.

(21) Appl. No.: 17/540,135

(22) Filed: Dec. 1, 2021

(65) Prior Publication Data

US 2023/0151465 A1 May 18, 2023

(30) Foreign Application Priority Data

Nov. 15, 2021 (KR) ..... 10-2021-0156515

(51) Int. Cl.

| | |
|---|---|
| ***C22C 38/10*** | (2006.01) |
| ***C22C 38/04*** | (2006.01) |
| ***C21D 9/50*** | (2006.01) |

(52) U.S. Cl.

CPC ..... *C22C 38/105* (2013.01); *C21D 9/50* (2013.01); *C22C 38/04* (2013.01); *C21D 2211/001* (2013.01); *C21D 2211/008* (2013.01)

(58) Field of Classification Search

None

See application file for complete search history.

(56) References Cited

U.S. PATENT DOCUMENTS 6,221,183 B1 * 4/2001 Sato ..... C22C 38/52 420/95

FOREIGN PATENT DOCUMENTS

| | | | | |
|---|---|---|---|---|
| CN | 108220783 A | * | 6/2018 | ..... C21D 8/005 |
| JP | 2005-334887 A | | 12/2005 | |
| KR | 101304657 B1 | | 9/2013 | |
| KR | 101965666 B1 | | 4/2019 | |
| KR | 102237487 B1 | | 4/2021 | |

* cited by examiner

*Primary Examiner* — Anthony M Liang

(57) ABSTRACT

Proposed is a Fe-based alloy and a filler metal including the same. The Fe-based alloy contains 15% to 25% by weight of nickel (Ni), 0.5% to 3% by weight of manganese (Mn), 2% to 8% by weight of cobalt (Co), 0.1% to 0.5% by weight of carbon (C), and the balance iron (Fe) and unavoidable impurities.

10 Claims, 7 Drawing Sheets

A

B

C

D

E

FE-BASED ALLOY

CROSS REFERENCE TO RELATED APPLICATION

The present application claims priority to Korean Patent Application No. 10-2021-0156515, filed Nov. 15, 2021, the entire contents of which is incorporated herein for all purposes by this reference.

BACKGROUND OF THE INVENTION

1. Field of the Invention

The present disclosure relates to a Fe-based alloy having an austenite-martensite composite structure.

2. Description of the Related Art

Recently, as demand for low carbon energy has increased, the use of liquefied natural gas (LNG) that can replace oil is rising. In the case of LNG, since transport and storage are generally carried out at cryogenic temperatures below −160° C., sufficient strength and stability are required for ships and storage tanks handling LNG at cryogenic temperatures.

For this reason, low temperature materials such as Al alloy, 9% Ni steel, and stainless steel, which have excellent strength and impact toughness in a cryogenic environment, are attracting attention. In addition, research on materials for welding and bonding the low temperature material is also increasing.

Specifically, Patent Document 1 discloses welding joints including carbon, nitrogen, nickel, chromium, and the like. Patent Document 2 discloses a wire for welding rods, including manganese, nickel, chromium, molybdenum, and the like. In Patent Document 3, an iron-based flux-cored wire containing chromium, nickel, etc., for cryogenic use is disclosed.

However, since the disclosed materials contain expensive elements such as chromium (Cr), molybdenum (Mo), vanadium (V), and tungsten (W), they have low economic feasibility. Although it has shock absorption energy above the pre-grade standard, there is a problem in that the mechanical strength is relatively weak.

For this reason, there is a demand for a Fe-based alloy that secures economic feasibility by reducing expensive elemental components and has both excellent shock absorption energy and mechanical strength.

PATENT DOCUMENTS (Patent Document 1) Korea Patent No. 10-1304657 (2013 Aug. 30)

(Patent Document 2) Korea Patent No. 10-2237487 (2021 Apr. 1)

(Patent Document 3) Korea Patent No. 10-1965666 (2019 Mar. 29)

SUMMARY OF THE DISCLOSURE

The present disclosure proposes a Fe-based alloy that does not use expensive elements such as chromium (Cr), molybdenum (Mo), vanadium (V), and tungsten (W).

In addition, the present disclosure proposes a Fe-based alloy with improved stability and mechanical strength, the Fe-based alloy being prepared by appropriately adjusting the content of each component to form austenite and martensite at room temperature after solidification.

In order to solve the problems occurring in the related arts, the present disclosure proposes a Fe-based alloy containing: 15% to 25% by weight of nickel (Ni); 0.5% to 3% by weight of manganese (Mn); 2% to 8% by weight of cobalt (Co); 0.1% to 0.5% by weight of carbon (C); and the balance iron (Fe) and unavoidable impurities.

In one embodiment of the present disclosure, a Fe-based alloy contains: 15% to 25% by weight of nickel (Ni); 0.5% to 3% by weight of manganese (Mn); 2% to 8% by weight of cobalt (Co); 0.1% to 0.5% by weight of carbon (C); and the balance iron (Fe) and unavoidable impurities.

In the embodiment, the nickel (Ni) and the manganese (Mn) may be contained to satisfy a condition of 18% by weight≤[Ni]+[Mn]<25% by weight, in which [Ni] represents the weight content of nickel (Ni) and [Mn] represents the weight content of manganese (Mn).

In the embodiment, the Fe-based alloy may have a martensite start (Ms) temperature higher than room temperature (25° C.).

In the embodiment, the martensite may have a volume fraction of 90%.

In another embodiment of the present disclosure, a Fe-based filler metal including the Fe-based alloy is proposed.

In the embodiment, when the filler metal is used for welding, a resulting welded joint may contain austenite and martensite.

In the embodiment, the welded joint may satisfy a condition of 0.8≤[A]/[M]<1.3, in which [A] represents the fraction (% by area) of the austenite in the welded joint and [M] represents the fraction (% by area) of the martensite in the welded joint.

In the embodiment, the fraction (% by area) of the martensite of the welded joint may be greater than the fraction (% by area) of the austenite.

In the embodiment, when the filler metal is used for welding, a resulting welded joint may have a tensile strength of 670 MPa or more at room temperature.

In the embodiment, when the filler metal is used for welding, a resulting welded joint may have a Charpy impact toughness of 27 J or more at −196° C.

The present disclosure may provide a Fe-based alloy with a composite structure including austenite and martensite after solidification. The Fe-based alloy enables a welded joint with excellent strength and cryogenic impact toughness even it contains expensive elements in a reduced amount compared to a conventional filler metal.

DESCRIPTION OF THE PREFERRED EMBODIMENTS

Figure 1:
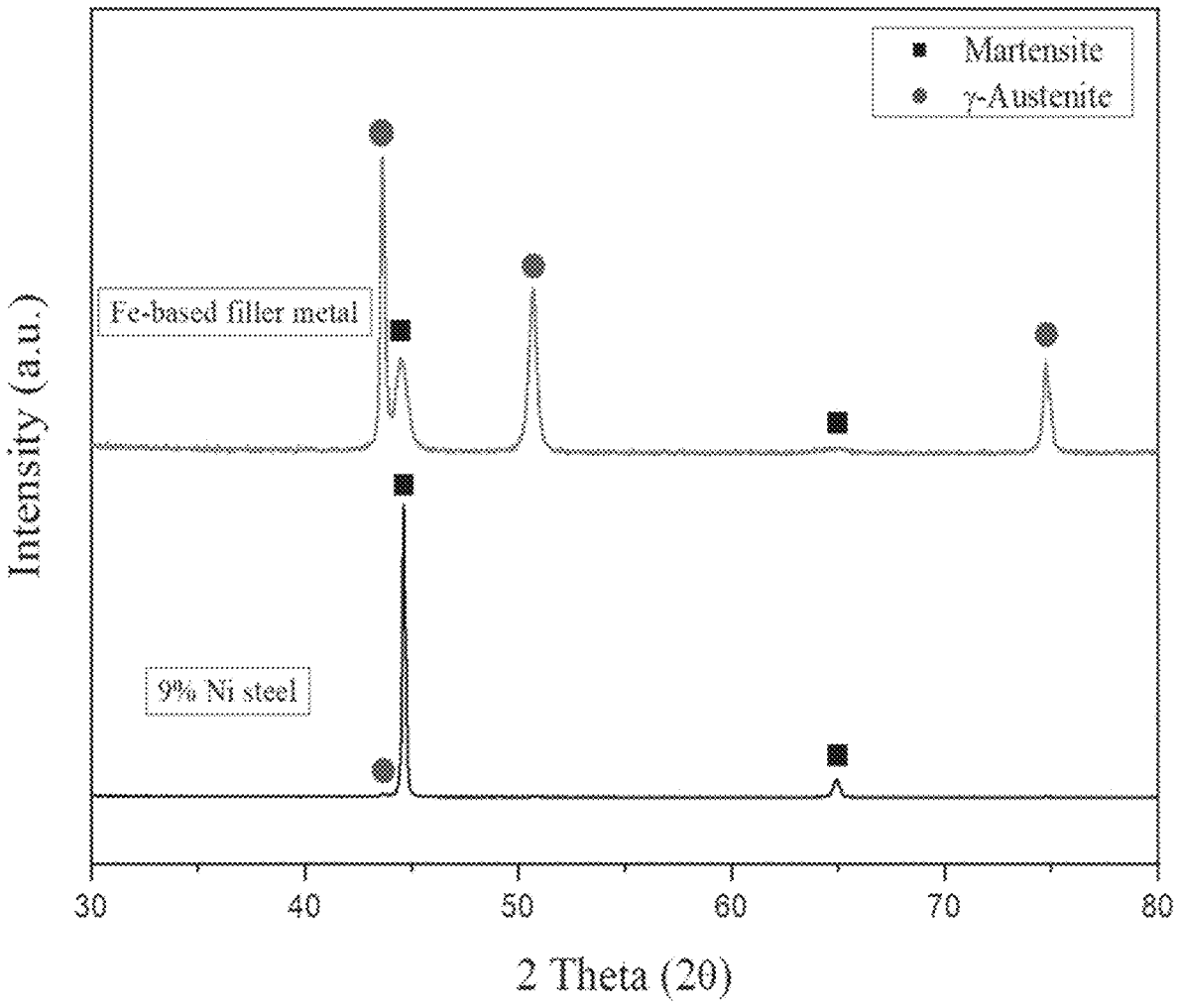
FIG. 1 is a view illustrating comparison results of X-ray diffraction (XRD) for an Fe-based alloy prepared according to one example of the present disclosure and 9% Ni steel according to a related art.

Hereinbelow, an Fe-based alloy according to the present disclosure will be described in detail. The accompanying drawings are provided for illustrative purposes so that the spirit of the present disclosure can be sufficiently conveyed to those skilled in the art. Accordingly, the present disclosure is not limited to the drawings and may be embodied in other forms. The drawings may be exaggerated in scale to clarify the spirit of the present disclosure. Unless otherwise defined, all terms including technical and scientific terms used herein have the same meaning as commonly understood by those who are ordinarily skilled in the art to which this invention belongs. Details of well-known functions and configurations may be omitted to avoid unnecessarily obscuring the gist of the present invention.

One embodiment of the present disclosure relates to a Fe-based alloy having an application in a structure used in a cryogenic environment of −160° C. or less.

Conventionally, Al, 9% Ni steel, stainless steel, etc. have been used for applications in a cryogenic environment of −160° C. or less due to excellent impact toughness thereof in the cryogenic environment. Among them, 9% Ni steel is most widely used as a low temperature material because it is inexpensive and has excellent weldability compared to Al and stainless steel.

However, such 9% Ni steel as a low temperature material is disadvantageous in that the manufacturing cost thereof is high because it is required to contain expensive elements such as chromium (Cr), molybdenum (Mo), vanadium (V), and tungsten (W). In addition, the 9% Ni steel has the problem of relatively weak mechanical strength although it has high impact absorption energy above ship construction standards.

Accordingly, the present disclosure proposes a Fe-based alloy that is based on Fe and additionally contains nickel (Ni), cobalt (Co), manganese (Mn), and carbon (C). According to the present disclosure, when preparing the Fe-based alloy, austenite is stabilized with nickel (Ni) and manganese (Mn) without using chromium (Cr), and the contents of cobalt (Co) and carbon (C) are controlled such that the Fe-based alloy has an austenite-martensite composite structure after solidification.

Hereinafter, the composition of the Fe-based alloy according to one embodiment of the present disclosure will be described in detail.

A Fe-based alloy according to one embodiment of the present disclosure may contain: 15% to 25% by weight of nickel (Ni); 0.5% to 3% by weight of manganese (Mn); 2% to 8% by weight of cobalt (Co); 0.1% to 0.5% by weight of carbon (C); and the balance iron (Fe) and unavoidable impurities.

The nickel (Ni) may be contained in an amount of 15% to 25% by weight.

In the Fe-based alloy, the nickel (Ni) introduced into iron (Fe) which is the base material of the Fe-based alloy acts as an austenite stabilizing element. Specifically, when the content of nickel (Ni) in iron (Fe) is 15% by weight or more, an austenite matrix is formed during solidification, resulting in improvement in oxidation resistance, strength, and toughness. On the other hand, when the content of nickel (Ni) is less than 15% by weight, the austenite structure is not formed so that a low-temperature toughness may be greatly reduced.

On the other hand, when the content of nickel (Ni) exceeds 25% by weight, the austenite is excessively created. Therefore, martensite is not formed during the solidification so that the mechanical properties of the Fe-based alloy may be deteriorated.

For this reason, the nickel (Ni) may be contained in an amount of 15% to 25% by weight and more preferably in an amount of 18% to 22% by weight. In an embodiment, nickel (Ni) may be contained in an amount of 19% to 21%, 19.5% to 20.5%, or 19.7% to 20.3% by weight.

Manganese (Mn) is contained in an amount of 0.5% to 3% by weight.

Manganese (Mn) is an austenite stabilizing element like the nickel (Ni). When manganese (Mn) is contained in an amount of 0.5% to 3% by weight, an $M_{90}$ temperature at which martensite accounts for a volume fraction of 90% is lowered to about −80° C. so that the Fe-based alloy may maintain the austenite structure even after the Fe-based alloy is solidified at room temperature. When the content of manganese (Mn) is less than 0.5% by weight, since the austenite structure is not formed, the cryogenic toughness may be reduced. On the other hand, when the content of manganese (Mn) exceeds 3% by weight, the austenite structure may be excessively formed.

For this reason, manganese (Mn) is preferably contained in an amount of 0.5% to 3% by weight and more preferably in a range of 2% to 3% by weight.

Cobalt (Co) is contained in an amount of 2% to 8% by weight.

Cobalt (Co) may raise the martensite start temperature (Ms temperature) during the solidification. When cobalt is contained in an amount of 2% by weight or more, the Ms temperature may be higher than room temperature (25° C.). When cobalt is contained in an amount of 2% by weight or more, the Ms temperature is increased to 70° C. or more. Specifically, the Ms temperature becomes as high as 73.2° C. The martensite structure remains even at room temperature after the solidification, so that the mechanical strength of the Fe-based alloy may be improved. On the other hand, when cobalt (Co) is contained in an amount of less than 2% by weight, the martensite does not remain at room temperature, so that the mechanical strength may be deteriorated.

On the other hand, when the content of cobalt (Co) exceeds 8% by weight, the martensite is excessively formed, and the austenite is insufficiently formed. In this case, the low-temperature toughness may be reduced. For this reason, cobalt (Co) may be contained preferably in an amount of 2% to 8% by weight and more preferably in an amount of 3% to 7% by weight. In an embodiment, cobalt (Co) may be contained in an amount of 4% to 6%, 4.5% to 5.5%, or 4.7% to 5.3% by weight.

Carbon (C) is contained in an amount of 0.1% to 0.5% by weight.

Carbon (C) may form carbides, thereby increasing the strength of the Fe-based alloy. In addition, Carbon (C) may contribute to formation of martensite in the alloy. When the content of carbon (C) in the alloy is 0.1% by weight or more, lath martensite may be formed in the austenite. For this reason, it is preferable that the Fe-based alloy contains carbon (C) in an amount of 0.1% by weight or more.

On the other hand, when the content of carbon (C) exceeds 0.5% by weight, the martensite is excessively formed in the alloy. As a result, the lath martensite that can coexist with the austenite in the alloy transforms into plate martensite, and the austenite may disappear. For this reason, carbon (C) is preferably contained in an amount of 0.1% to 0.5% by weight and more preferably 0.2% to 0.3% by weight.

The remaining component in the present disclosure is iron (Fe). However, impurities may be unavoidably introduced from the raw material or the surrounding environment. Therefore, common impurities may be introduced during the manufacturing process, and the effect thereof will not be described.

According to one embodiment, the Fe-based alloy may satisfy the condition "18≤[Ni]+[Mn]<25". Here, [Ni] and [Mn] each mean the weight content of the corresponding element.

When the total content of nickel (Ni) and manganese (Mn) in the Fe-based alloy is less than 18% by weight, since the amount of the austenite stabilizing element is insufficient, the austenite structure formed in the alloy may be reduced. This reduced austenite structure deteriorates the stability of the alloy, causing the shock absorption energy of the alloy to drop sharply and the brittleness of the alloy to increase in a cryogenic environment below −160° C. On the other hand, when the total content of nickel (Ni) and manganese (Mn) is 18% by weight or more, austenite is stabilized at the eutectic temperature (727° C.) or higher to form an austenite structure. For this reason, the total content of nickel (Ni) and manganese (Mn) is preferably 18% by weight or more.

On the other hand, when the total content of nickel (Ni) and manganese (Mn) is 25% by weight or more, the Ms temperature drops below room temperature, and a martensite structure is not formed in the alloy during the solidification process. Therefore, the mechanical strength of the Fe-based alloy may be reduced.

For this reason, the total content of nickel (Ni) and manganese (Mn) is preferably determined to be 18% by weight or more and to be less than 25% by weight. More preferably, the total content of nickel and manganese may be in a range of 20 [Ni]+[Mn]<23 where [Ni] and [Mn] each mean the weight content of the corresponding element.

When cobalt (Co) is contained in an amount of 2% to 8% by weight and carbon (C) is contained in an amount of 0.1% to 0.5% by weight in a state in which nickel (Ni) is contained in an amount of 15% to 25% by weight and manganese (Mn) is contained in an amount of 0.5% to 3% by weight, the martensite start (Ms) temperature of the Fe-based alloy may be higher than room temperature (25° C.), and may be more preferably increased to fall within a range of 70° C. to 75° C.

In addition, since the content of cobalt (Co) is 2% to 8% by weight and the content of carbon (C) is 0.1 to 0.5% by weight, the $M_{90}$ temperature at which martensite accounts for a volume fraction of 90% in the alloy may rise to −70 to −90° C. This is because cobalt (Co) and carbon (C) increase the martensite start temperature Ms to room temperature (25° C.) or higher, resulting in rise in the $M_{90}$ temperature. In other words, in the present disclosure, the content of cobalt (Co) and the content of carbon (C) are controlled so that the martensite structure can exist in the alloy.

In other words, when cobalt (Co) and carbon (C) are contained in an amount of 2% to 8% and an amount of 0.1% to 0.5%, respectively in a state in which nickel (Ni) and manganese (Mn) are contained in an amount of 15% to 25% and an amount of 0.5% to 3%, the Fe-based alloy may have an austenite-martensite composite structure at room temperature The Fe-based alloy according to one embodiment of the present disclosure has been described above.

Another embodiment of the present disclosure relates to a filler metal containing the above-described Fe-based alloy. In describing the filler metal, a redundant description of the Fe-based alloy contained in the filler metal may be omitted because the Fe-based alloy is described above.

When the filler metal containing the Fe-based alloy according to one embodiment of the present disclosure is used for welding, a welded joint may have an austenite-martensite composite structure. More preferably, a weld bead formed in the center of the welded joint has lath martensite and austenite structure formed around the lath martensite.

According to one embodiment, the fraction of austenite is relatively high in a center portion of the weld bead because the center portion has a relatively low cooling rate, and the fraction of martensite is relatively high in a lower portion of the weld bead.

In addition, in the heat-affected zone (HAZ) around the weld bead, the closer to the weld bead, the higher fraction of austenite, and the closer to the fusion line (or called fusion boundary), the higher fraction of martensite.

In the embodiment, when the Fe-based filler metal is used for welding, the fraction (% by area) of austenite in the welded joint is defined as [A], and the fraction (% by area) of martensite is defined as [M], the [A] and [M] may satisfy 0.8≤[A]/[M]<1.3. In an embodiment, an area on which the fractions of austenite and martensite are defined may be a cross-sectional area obtained by cutting the welded joint by a plane parallel to a given direction (e.g., a direction substantially orthogonal to a top surface of the welded joint). For example, the fractions (% by area) of austenite and martensite may be defined on a given area in the weld bead and the heat-affected zone (HAZ) of the welded joint shown in FIG. 2.

The condition in which [A]/[M] is less than 0.8 means that the martensite fraction of the welded joint is relatively high. In this case, the stability of the welded joint is deteriorated in a cryogenic environment, resulting in an increase in brittleness.

The condition in which [A]/[M] exceeds 1.3 means that the martensite fraction of the welded joint is relatively low. In this case, the mechanical properties, especially hardness and strength, of the welded joint are significantly reduced.

For this reason, the [A]/[M] is preferably determined to be in a range of 0.8 to 1.3. In an embodiment, the [A]/[M] may be in a range of 0.8 to 1.2 or 0.81 to 1.1.

More preferably, in the welded joint, the fraction (% by area) of martensite may be higher than the fraction (% by area) of austenite. When the fraction (% by area) of martensite structure is equal to or less than the fraction (% by area) of austenite, since the fraction of martensite which has relatively excellent mechanical properties is low, it is difficult to obtain sufficient tensile strength and hardness at room temperature. For this reason, according to the present disclosure, in the welded joint, the fraction of martensite may exceed 50% by area but may not exceed 55% by area. More preferably, the fraction of martensite may exceed 50% by area but may not exceed 53% by area.

Due to these features, when the Fe-based filler metal according to one embodiment of the present disclosure is used for welding, a welded joint having a tensile strength of 610 MPa or more at room temperature and a hardness of 300 Hv or more may be formed, and a welded joint having a Charpy impact toughness of 27 J or more at −196° C. may be formed.

Hereinafter, the present disclosure will be described in more detail with reference to an example presented below. However, it should be noted that the following example is provided only for illustrative purposes and are not intended to limit the scope of the present disclosure. This is because the scope of the present disclosure is determined by the matters recited in the claims and the matters reasonably inferred therefrom.

EXAMPLE

An ingot having an alloy composition shown in Table 1 was prepared and heated at 1100° C. to prepare a billet.

Thereafter, the billet was hot rolled at 800° C., cooled to room temperature at a cooling rate of 10° C./second and then drawn to prepare an alloy for a filler metal having a diameter of 2 mm.

Next, 9% Ni steel having a composition of Fe-8.86Ni-0.6Mn-0.25Si—0.06C was welded through tungsten arc welding (TIG) using each of filler metals prepared according to Example 1 and Comparative Examples 1 to 4. In the welding, the thickness of 9% Ni steel was 15 mm, the welding was performed under conditions of 110 A, 12 V, and torch angle of 45±10°, and manual welding in the presence of an argon shielding gas. After the welding, the microstructure, tensile strength, Vickers hardness, and impact characteristics of each of the welded joints were measured. The measurement results are shown in Table 1.

For the measurement, a tensile specimen in a square shape of ASTM E8 sub-size was taken from each of the welded joints and the tensile strength of each welded joint was measured at room temperature of 25° C. For the impact characteristic test, a standard test piece (KS B0809 V-notch specimen) was taken from the center of a deposited metal in a perpendicular direction to a weld line for each welded joint, and the impact characteristic was measured at −196° C. using a Charpy impact tester.

TABLE 1

| | | | | | Weld part microstructure (area %) | | Vickers Hardness | Tensile Strength | Impact Characteristics |
|---|---|---|---|---|---|---|---|---|---|
| | Ni | Mn | Co | C | A | M | (Hv) | (MPa) | (J) |
| Example 1 | 20 | 2.5 | 5 | 0.2 | 47.99 | 52.01 | 302 | 971 | 27 or more |
| Comparative Example 1 | 22 | 3 | 5 | 0.2 | 100 | — | 124 | 397 | 27 or more |
| Comparative Example 2 | 20 | 2.5 | 1 | 0.2 | 100 | — | 164 | 526 | 27 or more |
| Comparative Example 3 | 20 | 5 | 5 | 0.2 | 100 | — | 120 | 385 | 27 or more |
| Comparative Example 4 | 20 | 2.5 | 5 | 0.8 | 100 | — | 184 | 591 | 27 or more |
| Comparative Example 5 | 16 | 4 | 0.5 | 0.2 | 63.13 | 36.87 | 246 | 812 | 27 or more |
| Comparative Example 6 | 20 | 2.5 | 11 | 0.2 | 36.95 | 63.05 | 310 | 995 | 14.25 |

* In Table 1, the content of each component is represented in units of % by weight and the remainder is Fe and impurities.

* In Table 1, A is the fraction (% by area) of austenite, and M is the fraction (% by area) of martensite.

A. Microstructure Comparison of Welded Joints

FIG. 1 is a view illustrating the comparison results of X-ray diffraction (XRD) for a welded joint formed by using the filler metal of Example 1 and for a welded joint formed by using a conventional 9% Ni steel filler metal. The XRD results illustrated in FIG. 1 were obtained using EMPYREAN which is an X-ray diffractometer (manufactured by Malvern Panalytical Ltd.) under conditions of 30° to 80° symmetrical analysis, 3°/min scan rate, and 0.02° step size.

Referring to FIG. 1, it is seen that the welded joint prepared according to Example 1 has both an austenite structure and a martensite structure.

Specifically, it was confirmed that the welded joint prepared in Example 1 had a martensite fraction (% by area) higher than an austenite fraction (% by area). More specifically, the welded joint had 51% to 58% by area of martensite and the remaining fraction of austenite.

On the other hand, when the filler metals prepared in Comparative Examples 1 and 3 were used for welding, austenite was dominant in each of the welded joints formed with the respective filler metals. In the cases, the total content of nickel (Ni) and manganese (Mn) in the filler metal was 25% by weight, lowering the martensite start temperature Ms to room temperature or below. For this reason, martensite was not formed during solidification.

This resulted in the welded joints in which martensite was not present at all or was present very little. Therefore, the welded joints had a Vickers hardness of 125 Hv or less and a tensile strength of 400 MPa or less.

In Comparative Examples 2 and 4, although the total content of nickel (Ni) and manganese (Mn) in each of the filler metals satisfied the range of $18 \leq [Ni]+[Mn] < 25$, austenite was dominant in the structure of each of the welded joints. The reason is considered that the total content of cobalt (Co) and carbon (C) was not sufficient.

Specifically, in Comparative Example 2, since cobalt (Co) was contained insufficiently to be as low as less than 2% by weight, the martensite start temperature Ms was lower than 25° C., resulting in a very small amount of martensite in the welded joint. On the other hand, in Comparative Example 4, since the content of carbon (C) was less than 0.1% by weight, austenite was excessively formed.

For this reason, although the welded joint formed using the filler metal of Example 2 had the strength and hardness higher than those the welded joints formed using the filler metals of Comparative Examples 1 and 3, the welded joint according to Example 2 exhibited significantly deteriorated mechanical properties compared to the welded joint according to Example 1 of the present disclosure in which austenite and martensite coexist.

From the comparison results, it has been found that when an iron alloy contains 15% to 25% by weight of nickel (Ni), 0.5% to 3% by weight of manganese (Mn), 2% to 8% by weight of cobalt (Co), and 0.1% to 0.5 wt % by weight of carbon (C), the iron alloy has an austenite-martensite composite structure. Since the ratio of austenite and martensite is optimized in the iron alloy, a weld joint exhibiting a tensile strength of 610 Mpa or more at room temperature a hardness of 300 Hv or more while maintaining an impact characteristic of 27 J or more can be formed.

B. Comparison of Mechanical Properties According to Composition

Referring to Table 1, the welded joint formed using the filler metal according to Example 1 of the present disclosure had a tensile strength of 971 MPa and a Vickers hardness of 302 Hv. That is, the welded joint according to Example 1 of the present disclosure was superior to the welded joints according to Comparative Examples 1 to 4 in terms of mechanical strength. This was because only austenite existed in the welded joints according to Comparative Examples 1 to 4 whereas the welded joint according to Example 1 contains austenite in a fraction of 47.99% by area and martensite in a fraction of 52.01% by area. That is, the welded joint according to Example 1 had an austenite-martensite composite structure.

On the other hand, the welded joint according to Comparative Example 5 exhibited a good impact property of 27 J or more but exhibited weak mechanical properties due to an insufficient fraction of martensite. That is, Comparative Example 5 was inferior to Example 1 of the present disclosure in terms of tensile strength and Vickers hardness.

Comparative Example 6 exhibited higher levels of strength and hardness than Example 1 but it exhibited a significantly reduced impact property of 4.25 J. This was because the fraction of austenite in Comparative Example 6 was lower than that in Example 1, resulting in deterioration in the stability of the material. As a result, the impact energy absorption rate decreases, and the impact characteristics deteriorate.

Figure 2:
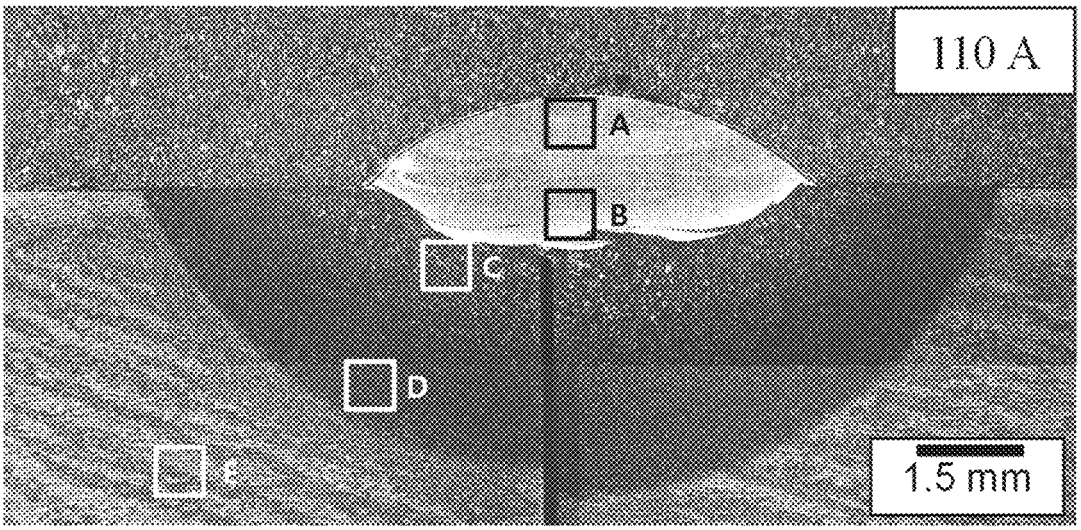
FIG. 2 is a cross-sectional view of a welded joint formed using an Fe-based alloy prepared in Example 1 of the present disclosure.
Figure 3A:
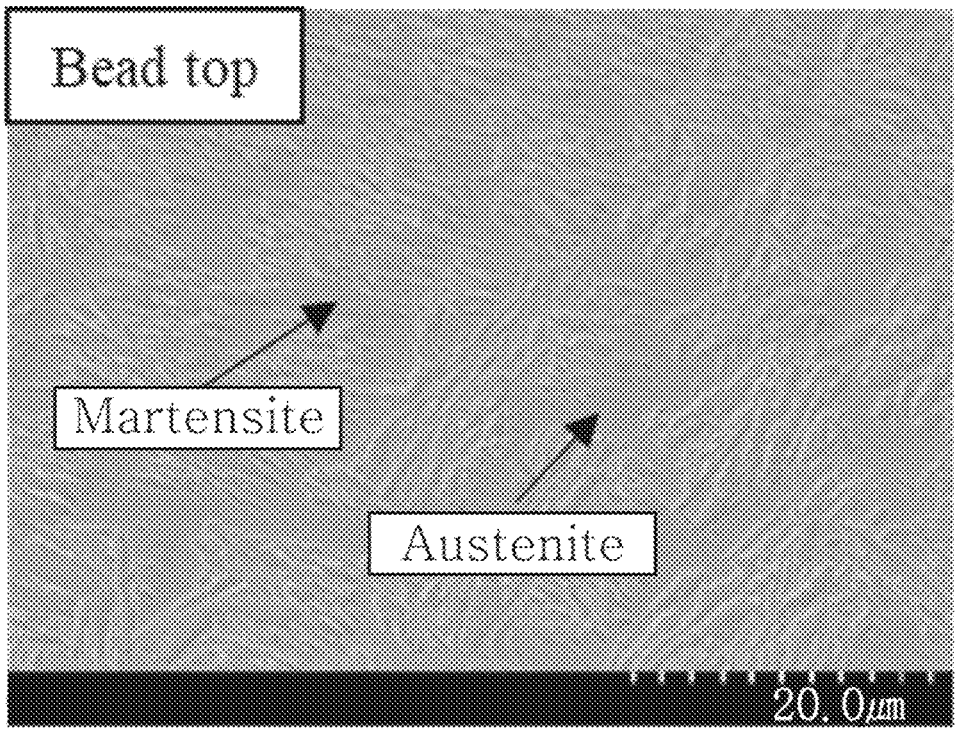
FIGS. 3A and 3B are photographs of the microstructures of A and B regions of FIG. 2, respectively.
Figure 3B:
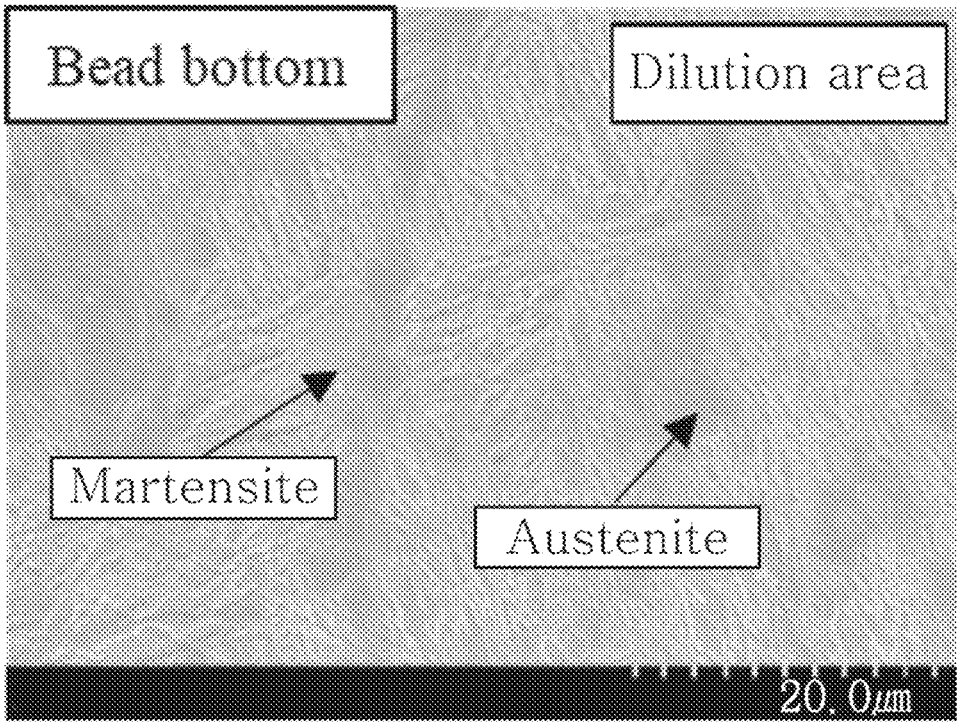
Figure 4A:
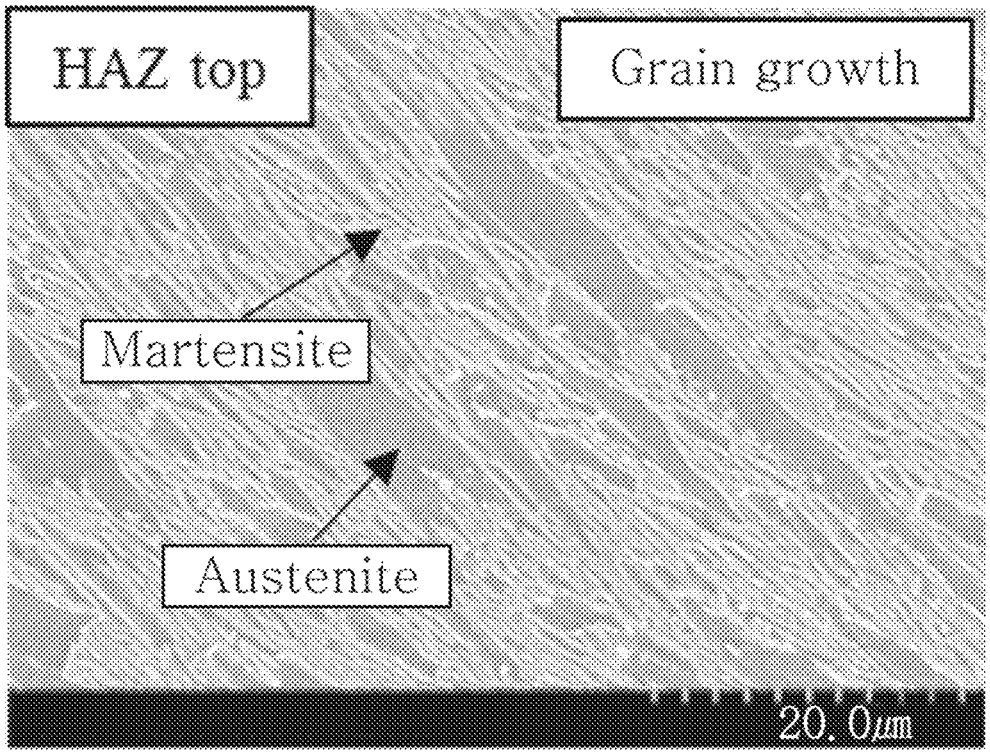
FIGS. 4A, 4B, and 4C are photographs of the microstructures of C, D, and F regions of FIG. 2, respectively.
Figure 4B:
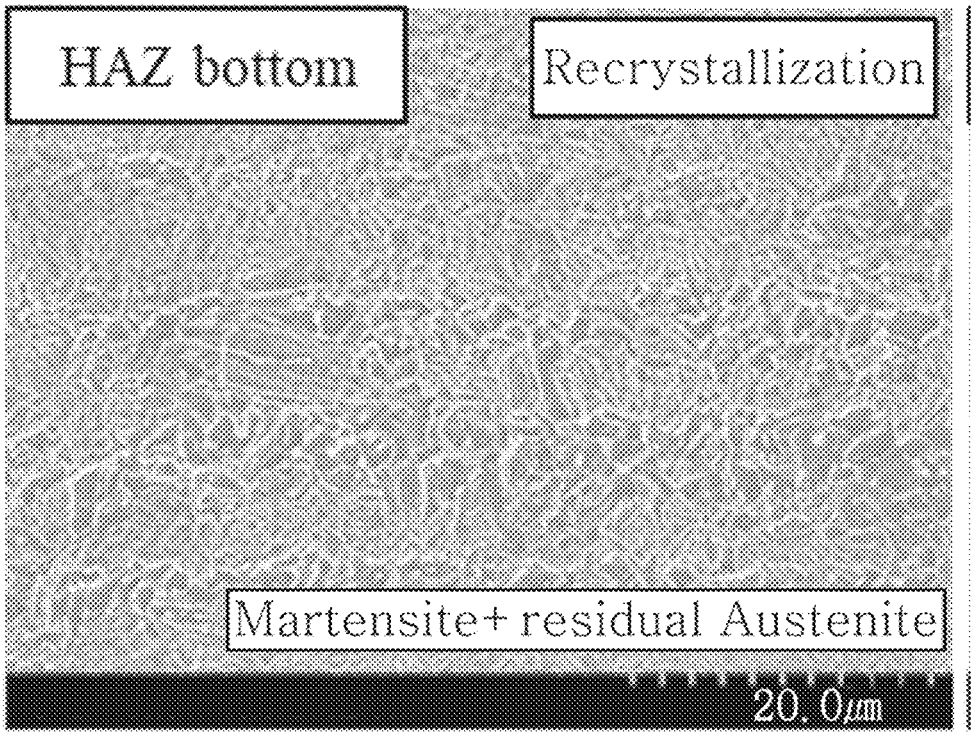
Figure 4C:
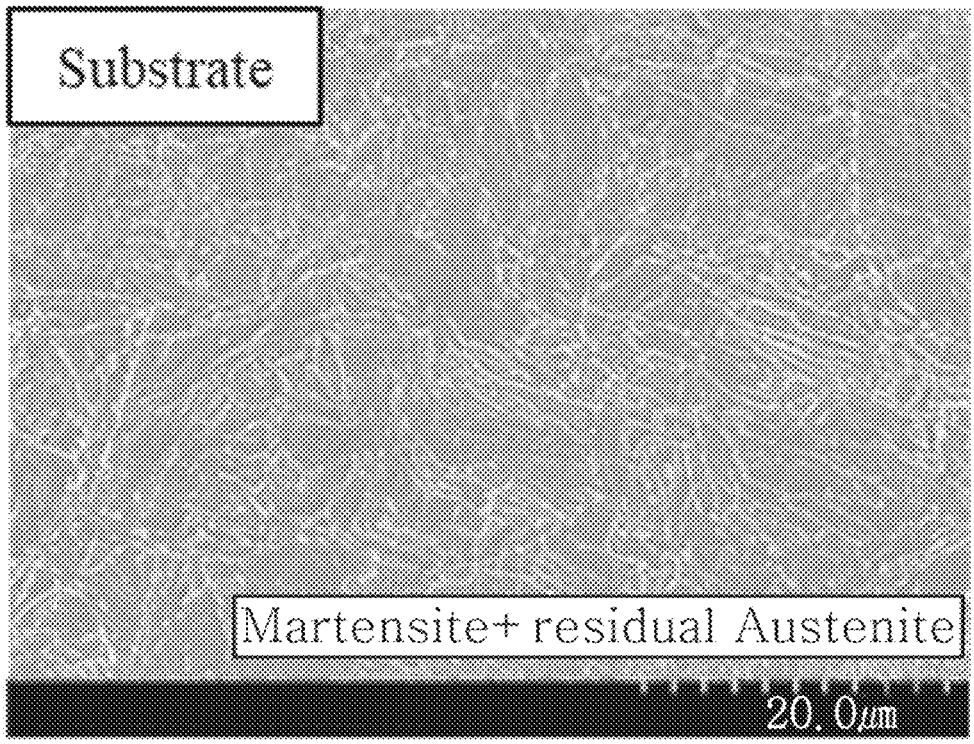

FIG. 2 is a cross-sectional view of the welded joint formed using the filler metal of Example 1 of the present disclosure, FIGS. 3A and 3B are photographs of the microstructures of A and B zones of FIG. 2, respectively, and FIGS. 4A, 4B, and 4C are photographs of the microstructures of C, D, and F zones of FIG. 2, respectively.

In order to observe the microstructure at some positions of the welded joint formed according to Example 1, the welded joint was cut as shown in FIG. 2. The microstructure of each of the upper end of the weld bead (see A in FIG. 2), the lower end of the weld bead (see B in FIG. 2), the upper end of the heat-affected zone (HAZ) (see C in FIG. 2), the lower end of the heat-affected zone (HAZ) (see D in FIG. 2), and the base material outside a fusion line (E in FIG. 2) were compared.

Referring to FIG. 3, the austenite-the martensite composite structure was observed at both the upper end of the weld bead (see FIG. 3A) and the lower end of the weld bead (see FIG. 3B). More preferably, lath martensite was observed at both the upper and lower ends of the weld bead, and austenite was observed around the lath martensite. Since the weld bead has the austenite-martensite composite structure, the welded joint has both the stability which is the advantage of austenite and the rigidity which is the advantage of martensite.

In addition, the upper end of the weld bead has a higher austenite fraction than the lower end of the weld bead, and the lower end of the weld bead has a relatively high martensite fraction. This is because the cooling rate is low at the upper end of the weld bead is low and thus a relatively large amount of austenite is produced at the upper end. Since the Ni content decreases toward the lower end of the weld bead, the stabilization effect provided by austenite also decreases toward the lower end of the weld bead. As a result, it is considered that at the lower end, the fraction of austenite structure is relatively low and the fraction of martensite is relatively high.

Referring to FIGS. 4A and 4B, the austenite-martensite composite structure is observed at the upper end (FIG. 4A) and the lower end (FIG. 4B) of the heat-affected zone (HAZ). However, austenite occupies a larger area than martensite at the upper end of the heat-affected zone (HAZ), whereas martensite occupies a larger area than austenite at the lower end of the heat-affected zone. the base material part shown in FIG. 4C has the similar structure to the lower end of the HAZ.

At the upper end of the HAZ, since welding heat remains, the structure may be coarse. On the other hand, the lower end of the HAZ undergoes recrystallization, resulting in the structure being fine.

As described above, according to one embodiment of the present disclosure, the Fe-based alloy contains: 15% to 25% by weight of nickel (Ni); 0.5% to 3% by weight of manganese (Mn); 2% to 8% by weight of cobalt (Co); 0.1% to 0.5% by weight of carbon (C); and the balance iron (Fe) and unavoidable impurities.

The Fe-based alloy may satisfy a condition of $18 \leq [Ni]+[Mn] < 25$ where [Ni] and [Mn] each mean the weight content of the corresponding element.

In addition, the martensite start (Ms) temperature of the Fe-based alloy may be higher than room temperature (25° C.), may be more preferably in a range of 70 to 75° C., and may be even more preferably 73.2° C.

In addition, the $M_{90}$ temperature at which martensite accounts for a volume fraction of 90% may be in a range of −70° C. to −90° C.

According to the present disclosure, a Fe-based alloy having a good impact toughness in a cryogenic environment of −160° C. or less may be prepared, or a filler metal using the Fe-based alloy may be prepared.

According to another embodiment, a Fe-based filler metal including the Fe-based alloy may be provided, and a welded joint containing both austenite and martensite may be formed when the Fe-based filler metal is used for welding.

According to embodiments, when the Fe-based filler metal is used for welding, the welded joint may satisfy a condition of $0.8 \leq [A]/[M] < 1.3$ in which [A] represents the fraction (% by area) of austenite in the welded joint and [M] represents the fraction (% by area) of martensite.

Even more preferably, the fraction (% by area) of martensite may be greater than the fraction (% by area) of austenite in the welded joint. For example, in the welded joint according to an embodiment of the present disclosure, the fraction of martensite may exceed 50% by area but may not exceed 55% by area. Even more preferably, the fraction of martensite structure may exceed 50% by area but may not exceed 53% by area.

As a result, the Fe-based filler metal according to the embodiment of the present disclosure has a tensile strength of 670 MPa or more at room temperature during welding and may form a welded joint with a Charpy impact toughness of 27 J or more at −196° C.

Although various embodiments of the present disclosure have been presented and described herein above, it will be easily understood by those skilled in the art that various substitutions, modifications, and changes may be made without departing from the technical idea of the present disclosure.

What is claimed is:

1. A Fe-based alloy containing: 15% to 20% by weight of nickel (Ni); 0.5% to 3% by weight of manganese (Mn); 2% to 8% by weight of cobalt (Co); and 0.1% to 0.5% by weight of carbon (C), the Fe-based alloy satisfying a condition of 18% by weight$\leq$[Ni]+[Mn]<25% by weight, wherein [Ni] represents the weight content of nickel (Ni) and [Mn] represents the weight content of manganese (Mn), wherein the Fe-based alloy has an austenite-martensite composite structure at room temperature, and is free from chromium (Cr), molybdenum (Mo), vanadium (V), and tungsten (W).

2. The Fe-based alloy of claim 1, wherein the Fe-based alloy has a martensite start (Ms) temperature higher than the room temperature.

3. The Fe-based alloy of claim 1, wherein an $M_{90}$ temperature at which martensite has a volume fraction of 90% is in a range of −70° C. to −90° C.

4. The Fe-based alloy of claim 1, wherein an amount of nickel (Ni) is in a range of 18% to 20% by weight.

5. The Fe-based alloy of claim 1, wherein an amount of manganese (Mn) is in a range of 2% to 3% by weight.

6. The Fe-based alloy of claim 1, wherein an amount of cobalt (Co) is in a range of 3% to 7% by weight.

7. The Fe-based alloy of claim 1, wherein an amount of carbon (C) is in a range of 0.2% to 0.3% by weight.

8. The Fe-based alloy of claim 1, further containing a balance iron (Fe) and unavoidable impurities.

9. The Fe-based alloy of claim 1, wherein an amount of nickel (Ni) is in a range of 18% to 20% by weight, an amount of manganese (Mn) is in a range of 2% to 3% by weight, an amount of cobalt (Co) is in a range of 3% to 7% by weight, and an amount of carbon (C) is in a range of 0.2 to 0.3% by weight.

10. The Fe-based alloy of claim 9, wherein the amount of nickel (Ni) is in a range of 19.7% to 20% by weight, and the amount of cobalt (Co) is in a range of 4.7% to 5.3% by weight.

* * * * *